US010806288B2

(12) United States Patent
Schöpfer et al.

(10) Patent No.: US 10,806,288 B2
(45) Date of Patent: Oct. 20, 2020

(54) SYSTEM FOR SUSPENSION OF A CURTAIN

(71) Applicant: Silent Gliss International AG, Gumligen (CH)

(72) Inventors: Simon Schöpfer, Wunnewil (CH); Beat Aebi, Brunnenthal (CH); Michel Frauchiger, Biglen (CH)

(73) Assignee: Silent Gliss International AG, Gumligen (CH)

( * ) Notice: Subject to any disclaimer, the term of this patent is extended or adjusted under 35 U.S.C. 154(b) by 0 days.

(21) Appl. No.: 16/462,008

(22) PCT Filed: Dec. 15, 2017

(86) PCT No.: PCT/EP2017/082991

§ 371 (c)(1),
(2) Date: May 17, 2019

(87) PCT Pub. No.: WO2018/114650

PCT Pub. Date: Jun. 28, 2018

(65) Prior Publication Data

US 2019/0328166 A1 Oct. 31, 2019

(30) Foreign Application Priority Data

Dec. 21, 2016 (CH) ..... 1700/16

(51) Int. Cl.
*A47H 15/00* (2006.01)
*A47H 1/04* (2006.01)
(Continued)

(52) U.S. Cl.
CPC ..... *A47H 1/04* (2013.01); *A47H 15/02* (2013.01); *A47H 15/04* (2013.01)

(58) Field of Classification Search
CPC ... Y10T 16/35; Y10T 16/3543; Y10T 16/355; Y10T 16/353; Y10T 24/51; A47H 1/00; A47H 1/04; A47H 1/13; A47H 1/124; A47H 5/02; A47H 5/03; A47H 5/0325; A47H 5/032; A47H 13/00; A47H 13/02; A47H 13/04; A47H 15/00; A47H 15/02; A47H 15/04
See application file for complete search history.

(56) References Cited

U.S. PATENT DOCUMENTS 2,966,695 A * 1/1961 Dwyer ..... A47H 15/04 16/93 D
3,187,370 A * 6/1965 Bieda ..... A47H 13/04 16/87.6 R (Continued)

FOREIGN PATENT DOCUMENTS

CH 702648 A2 * 8/2011 ..... A47H 15/04
DE 1139950 B 11/1962

(Continued)

*Primary Examiner* — Chuck Y Mah
(74) *Attorney, Agent, or Firm* — The Webb Law Firm

(57) ABSTRACT

A system for suspension of a curtain device has at least one curtain guide track and at least one curtain that is suspended on a plurality of suspension units with a guide element for guiding a suspension unit along the curtain guide track. The curtain guide track and the guide element provide a bearing surface. The system further has a silencing material provided on the bearing surface.

12 Claims, 6 Drawing Sheets

(51) Int. Cl.
*A47H 15/02* (2006.01)
*A47H 15/04* (2006.01)

(56) References Cited

U.S. PATENT DOCUMENTS 3,342,344 A * 9/1967 Magnuson ..... A47G 25/0692 211/113
4,282,630 A * 8/1981 Toder ..... A47H 13/00 16/93 D
4,356,902 A * 11/1982 Murphy ..... A61H 3/008 193/35 R
5,259,520 A * 11/1993 Roggio ..... A47H 1/04 16/94 D
5,421,059 A * 6/1995 Leffers, Jr. ..... A47H 1/104 16/87.4 R
5,960,967 A * 10/1999 Neil ..... A47F 5/0846 211/94.01
9,700,170 B1 * 7/2017 Kouts ..... A47H 15/02
2006/0225244 A1 * 10/2006 Melinette ..... A47H 15/04 16/93 R
2007/0277944 A1 * 12/2007 Wu ..... A47H 13/01 160/330
2008/0148526 A1 * 6/2008 Garcia ..... A47H 1/02 16/87 R
2010/0294441 A1 * 11/2010 Ligas, Sr. ..... A47H 5/03 160/341
2011/0225774 A1 * 9/2011 Seddon ..... A47H 15/04 16/94 D
2012/0018106 A1 * 1/2012 Robledo ..... A47H 13/04 160/330
2012/0198655 A1 * 8/2012 Lapping ..... E04H 15/18 16/91
2015/0173549 A1 * 6/2015 Zahner ..... A47H 13/02 160/330

FOREIGN PATENT DOCUMENTS

DE 202009010880 U1 * 12/2009 ..... A47H 15/04
EP 0596569 B1 * 10/1996 ..... A47H 1/04
JP 734787 U 6/1995
JP 889393 A 4/1996
JP 200161642 A 3/2001
JP 2001061642 A * 3/2001
NL 9200489 A * 10/1993 ..... A47H 15/04

* cited by examiner

SYSTEM FOR SUSPENSION OF A CURTAIN

CROSS-REFERENCE TO RELATED APPLICATIONS

This application is the United States national phase of International Application No. PCT/EP2017/082991 filed Dec. 15, 2017, and claims priority to Swiss Patent Application No. 01700/16 filed Dec. 21, 2016, the disclosures of which are hereby incorporated by reference in their entirety.

BACKGROUND OF THE INVENTION

Field of the Invention

The present invention relates to a system for suspension of a curtain device, comprising at least one curtain guide and at least one curtain or the like that is suspended on a plurality of suspension units with a guide element for guiding a suspension unit along the curtain guide.

Description of Related Art

A known objection of systems for suspension of a curtain device is the noise caused by the movement of the suspension units along the curtain guide. Even if the noise is small, it can be disturbing. For example in a hospital, in operating rooms, in theaters or cinemas or even in private space the noise of opening and closing a curtain device is undesirable.

The curtain guide for guiding and/or supporting an object provides at least one guide rail or track. The curtain guide track can be an elongated profile element or can comprise curved sections. The curtain guide also described as guide track or rail or profile element can be of substantially circular, oval, rectangular or other cross-section with any reasonable size. The curtain guide comprises at least a guide track providing a bearing surface for slidably mounting the guide elements.

Curtain guide tracks are known wherein at least one slot is formed in the guide track and open to the external surface of the guide track supporting a plurality of gliders or sliders or guide elements for movement along the guide track. For example, a known guide track can be formed with a hollow extruded track having an inside bearing surface wherein guide elements are moveably mounted for supporting a slidable curtain or the like and wherein the guide track opposite edges projecting from the side walls limit the width of the longitudinal track slot and an inner face forms sliding surfaces for internal guide elements, wherein said surfaces are inclined towards the track slot.

Another example of a guide track has a cross-section including generally upright web having a perpendicular base flange on which the guide elements can ride.

It is important to choose the profile of the mentioned bearing surfaces or sliding tracks of the guide track in such a manner and in conformity with the materials employed that a smooth and silent run of the guide elements is guaranteed. In case of guide tracks in form of extruded metallic shapes, especially aluminum alloy, the surface has to be finished to a "super-finish" quality in order to remove all grains from the extrusion skin which can be the source of further noise by movement of guide elements.

A suspension unit used in the system comprises at least a suspension element to which a curtain device or the like can be secured and a guide element for guiding in or at the guide track. The suspension element is used to support a curtain hook which is fitted into a pocket in a heading tape secured to a curtain. The guide element, i.e. the component moveable along the guide track of a curtain guide, is formed to slide on or in the track provided by the guide track. Furthermore, a guide element is formed as a roller to travel along the guide track on wheels or rollers.

To achieve a silent movement of guide elements moved along guide tracks different modifications are known. It is well-known that the guide element can be made of fiber, hard leather or other material which will serve the purpose and afford a minimum of friction and noise in use. But a guide element can be made also of synthetic plastic material, wherein it is formed with sliding surfaces convex in shape and wherein through the friction between the sliding surfaces of the guide track and the guide element a more durable wearing surface of the guide element is obtained to achieve noiseless movement thereof.

Furthermore it is known to make a guide element from a thin metal strip covered by a wrap of textile fiber, wherein the fabric can be woven, knitted or braided or felted. Known guide elements are made from metal wherein those parts of the guide element touching the guide rail may be faced or shod with an anti-friction material, i.e. the material can only cover essential parts of the guide elements.

Furthermore, it is known to obtain guide elements providing a substantially silent movement within or at the guide track by providing at essentially contact surfaces silencing materials. Therefore guide elements are known comprising a rigid body to which at one end a pair of rollers having tires formed of rubber or other deformable and preferably silencing material.

Additionally, it is known to provide cushions which slidably engage parts of the guide track in a manner to limit lateral swinging and silencing engagement of the guide element with parts of the guide track during opening and closing of the curtains. The cushions can be arranged in recesses formed at the contact portions between guide track and guide element.

SUMMARY OF THE INVENTION

However, there is still the problem of noise during movement of the guide elements along guide track caused by rolling or sliding friction.

The object of the present invention is therefore to propose a system for suspension of a curtain device comprising a guide track and a slidably mounted guide element to reduce the noise of the movement of the guide elements along the guide track, i.e. to provide a smooth and silent movement which is almost noiseless.

A further object is to propose a system for suspension of a curtain device which can be used with gliders formed to slide on the guide track as well as rollers adapted to roll on such track surfaces.

A still further object is that the guide element can have different shapes and forms and can be made of plastic material as molding.

The above mentioned objects are in particular achieved by the features of the independent claim, according to which a system for suspension of a curtain device, comprising at least one curtain guide track and at least one curtain or the like that is suspended on a plurality of suspension units with a guide element for guiding a suspension unit along the curtain guide track wherein the guide track and the guide element having a bearing surface. The bearing surface of the guide track provides the sliding or rolling surface on which the guide element is moved by sliding or rolling along, wherein the guide element comprises a bearing surface providing engagement with the guide track, i.e. the bearing surface of the guide track.

In each applications of the invention those parts where the guide element touches the curtain guide track a silencing material is provided to reduce friction and noise.

The system can be characterized in that at least one of the bearing surfaces provided by the guiding track and/or the guide element comprise a silencing material. According to the invention the expression bearing surface complies as well the bearing surface as at least partly a part adjacently to the bearing surface. The silencing material is chosen from a group comprising fiber composites, synthetic materials, wood and textile. Application of silencing material at least on one of the bearing surfaces reduces significantly the noise caused by moving guide elements along guide tracks.

The preferred silencing material is a fiber composite, mostly preferred felt. Herein the expression felt means a material made of matted and compressed fibers, pressed together using heat, moisture and/or pressure, wherein natural fibers such as wool or synthetic fibers such as polyamide, polyester etc. can be used. Felt is a material offering a wide versatility. Felt is an excellent sound insulator showing superb vibration damping properties. Felt is a vibration dampener mostly because its stress-deformation curve forms a hysterics loop, soaking most of the energy. Felt is highly resilient, retaining its strength and unique properties for a long time. Felt can be cut in any size, shape or thickness or can be heat formed and run through dies which will form it into shapes. Felt can be bonded to most surfaces.

Furthermore the silencing material may be impregnated with graphite, wax or other suitable lubricant. For example felt can be impregnated because of its reservoir properties. Felt can absorb and hold several times of its weight in various fluids, including lubricants. The ability of transfer the lubricant as needed to bearing surfaces through the felt makes felt an ideal lubricator.

In one embodiment of the invention, the silencing material is provided as a coating on at least one of the bearing surfaces of either the guide track or the guide element or both of them. The coating can be build up by application of the silencing material on at least one of the bearing surfaces for example by spraying.

The silencing material can be attached to the bearing surfaces by adhesion, welding and/or injection-molding, furthermore by crimping, rolled—in or as an insert.

Furthermore, the silencing material may be formed as an insert received in recesses formed on the bearing surfaces of the guide track and/or the guide element or both. In one embodiment an insert is made of a silencing material showing damping properties, wherein the insert is accommodated at the guide element made for example of a rigid material. Preferably the silencing material formed as an insert can be accommodated in a notch formed at the guide element, i.e. formed substantially parallel to the sliding surfaces. In this embodiment the insert is made of a softer material as the rigid material of the guide element wherein sliding surfaces are made of the rigid material.

In another embodiment the silencing material formed as an insert is accommodated such that the silencing material provides sliding surfaces. To improve the gliding properties a coating or a thin layer of a more rigid material can be provided on the sliding surfaces of such an insert. In one embodiment the silencing material formed as an insert is attached by pressing into a recess provided at least on one of the bearing surfaces. Preferably the recess is formed on the bearing surface of the guide element. The guide element can be of roller-type comprising a rigid body having an externally essentially cylindrical transverse portion within a transverse shaft is journaled. This shaft carries at its opposite ends a pair of rollers having wheels or rollers formed of another material than the rigid body. The material for the wheels may be a silencing material. In another embodiment of guide elements of roller-type the wheels are provided with a coating of silencing material or the bearing surface of the wheels are provided with a recess to insert a silencing material in this recess.

Furthermore, the guide element can comprise a body providing a recess for receiving an insert made of a silencing material. The insert received in the recess can be secured by an end cap which is connectable to the body such as to hold the insert in position.

The guide elements can be made of suitable plastic material, such as thermoplastic polymers as polypropylene, polyoxymethylen (acetal) or polyamide or compounding further comprising for example polytetrafluorethylene (PTFE). Furthermore, the guide element can be formed by two-component injection molding.

In a preferred embodiment of the invention, the guide elements are formed as gliders for sliding along the guide track, wherein the gliders are adapted for inwardly and outwardly sliding.

Guide elements are retained by the track for sliding or rolling movement along it. The guide element can be suitable for internal and external sliding or rolling depending on the type of the track and the guide element.

BRIEF DESCRIPTION OF THE DRAWINGS

The invention will now be described by way of example with reference to the accompanying drawings in which.

DESCRIPTION OF THE INVENTION

Figure 1B:
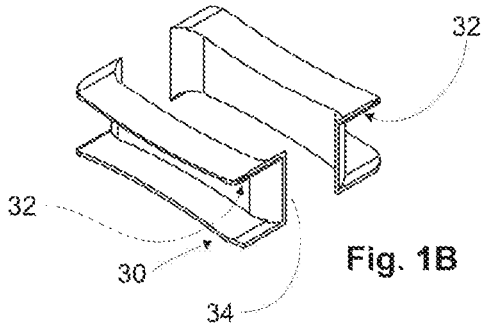
FIG. 1B is a schematic view of an insert for engagement with the guide element of FIG. 1A.

With reference to the above figures, the general reference numeral 10 indicates a guide element. FIG. 1A shows the guide element 10 having a body 12 with outwardly extending wings defining recesses 14 for cooperation with edges of a slot provided in a guide track (not shown). The body 12 of each guide element 10 has a depending eye 16 for receiving a curtain hook (not shown).

The guide elements 10 may be molded in one piece so as to have upper and lower horizontal walls 18, 20 respectively of which the wings constitute extensions, joined by forward and rear vertical walls 22. Herein the expressions of upper and lower refer to orientations with the guide elements supported by the track arranged in horizontally orientation. The opposing faces of the wing extensions of the upper and the lower walls 18, 20 which define recesses 14 are preferably slightly convex. Therefore, the spacing between the front and the rear vertical walls 22 of the guide element 10 increase to simplify the insertion of such a guide element 10 into the track and travel along. The portion of the body 12 of the guide element which defines the eye 16 extends downwardly from the lower horizontal wall 20, the underside of which is channeled so that the eye 16 has a partly circular profile. Other profiles for the eye 16 are possible, like rectangular etc.

Figure 1A:
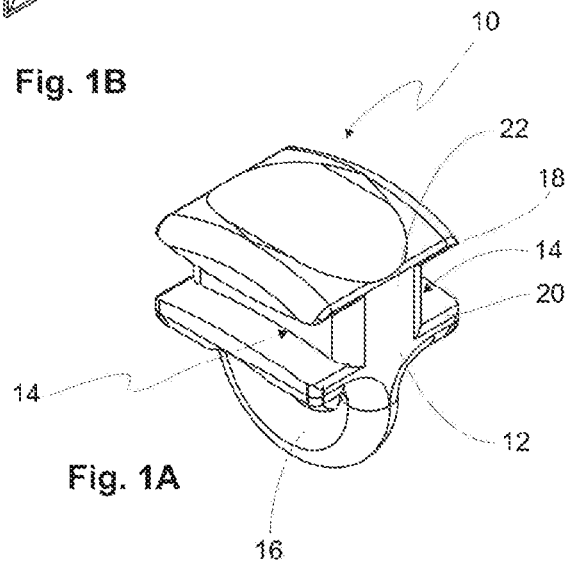
FIG. 1A is a schematic view of one embodiment of a guide element according to the invention.

In FIG. 1B an insert 30 made of a silencing material is seen. The insert 30 can be received into one of the recesses 14 formed between the opposing faces of the wing extensions of the upper and lower walls 18, 20. This insert 30 is provided with a linear sliding surface 32 projecting laterally from a vertical wall 34 and extending throughout the length of the insert 30. The sliding surface 32 can be seen as a bearing surface. The sliding surface 32 is convex in shape as the shape of the recesses 14 of the guide element 10.

With the slightly convex shape of the opposing faces of the wing extensions of the upper and lower walls 18, 20 of the guide element 10 the insert can be secured in position. Furthermore, at the forward and/or rear vertical walls 22 of the body 12 an end part of the upper and lower walls 18, 20 i.e. the wing extensions can be formed such that the spacing between them is slightly reduced to provide a certain barrier to hold the insert in position.

Figure 2:
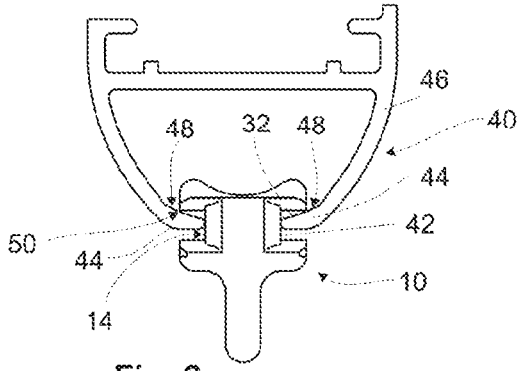
FIG. 2 is a schematic cross section view of guide element of FIG. 1 and a guide track.

Referring to FIG. 2 a system for suspension of a curtain device is shown, comprising a tubular guide track 40 made of metal, for example aluminum alloy, or plastic material having a longitudinal extending slot 42 in its underside, defined by two opposed flanges 44 projecting from the side walls 46, wherein the parts 48 of the flanges 44 providing a bearing surface 50 for the guide element 10. The parts 48 can be formed as to slope towards the slot 42, for example the parts 44 can form segments of a circle. The slot 42 is at least as wide as the width of the clearance of the guide element 10, therefore the parts 48 of the flanges 44 are received into the recesses 14 of the guide element 10. The sliding surface 32, providing a bearing surface of the guide element 10 is adapted to engage with the bearing surface 50 of the guide track 40.

Figure 3A:
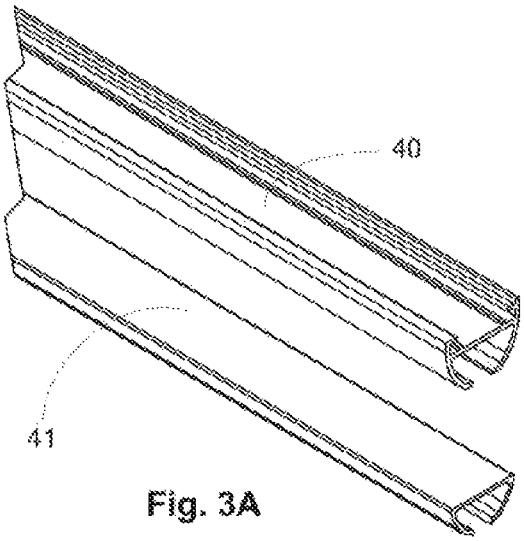
FIG. 3A, 3B are schematic views of one embodiment of a guide track according to the invention, wherein the guide track is combined with an insert.
Figure 3B:
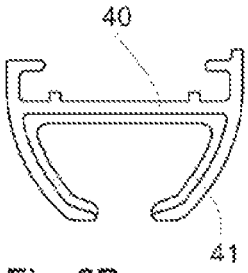

FIG. 3A shows a tubular guide track 40 made of metal, for example aluminum alloy, or plastic material. Furthermore it is shown an insert 41 formed to fit into the recess limited by the two opposed flanges 44 projecting from the side walls 46 of the guide track 41. The insert 41 can be made of any suitable silencing material. The insert 41 can be bonded in any appropriate way to the side walls 46 and the flanges 44 providing the bearing surface 50. Referring to FIG. 3B the insert 41 is accommodated into the recess formed by the parts of the guide track 40 and bonded thereto.

Figure 4:
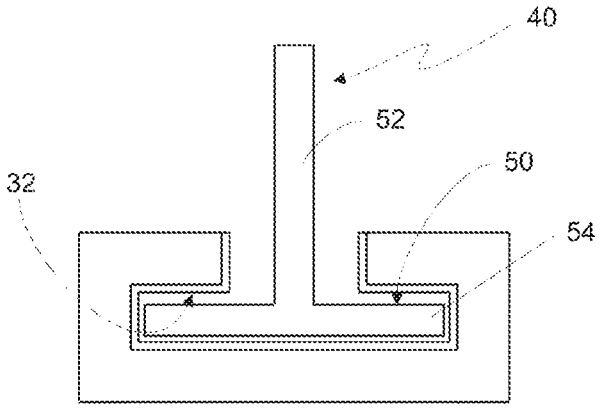
FIG. 4 is a schematic cross section view of another embodiment of a guide element in engagement with a guide track according to the invention.

Referring to FIG. 4, another embodiment of a guide element 10 is shown, wherein the guide element 10 is formed to correspond to an inversed T-shape guide track 40. The cross-section of the guide track 40 comprises a generally upright vertical wall 52 and a perpendicular base flange 54. The body of the guide element 10 is formed to provide a rectangular recess 14 partly opened, wherein the flange 54 of T-shape guide track 40 can be accommodated. The guide element 10 comprises the sliding surface 32 adapted to engage with bearing surfaces 50 of the basis flange 54 of the guide track 40. The sliding surface 32 can be provided by a coating of the walls of the recess 14 of the guide element 10 which are in contact with the bearing surface 50 of the guide track 40. Furthermore, the bearing surfaces 50 can be coated wherein the coating can be achieved by dipping in or spraying or brushing with liquid thermoplastic on at least roller or glider tracks and on the surfaces against which faces of rollers or gliders will engage. In addition, bearing surfaces 50 for example of aluminum tracks can be impregnated with silicon fluid.

Figure 5:
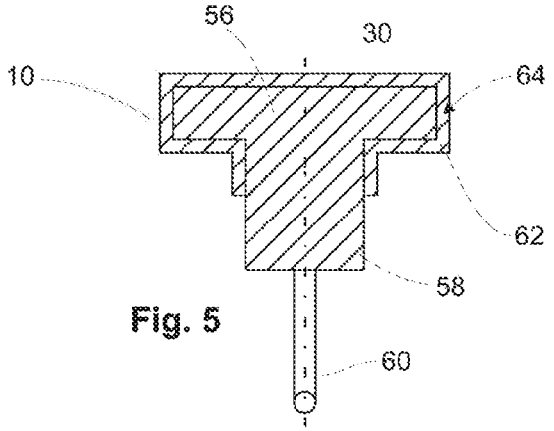
FIG. 5 is a schematic cross section view of a third embodiment of a guide element according to the invention.

In FIG. 5 the guide element 10 is formed as a cylindrical body 56 with a portion 58 of the body extending downwardly from a lower end of the cylindrical body 56 wherein in this downwardly extending portion 58 a ring 60 can be provided to receive a curtain hook (not shown). As can be seen from FIG. 5, parts 62 of the surface of the guide element 10 which are adapted to engage with parts of the guide track 40 (not shown) are coated by a silencing material 64.

Figure 6:
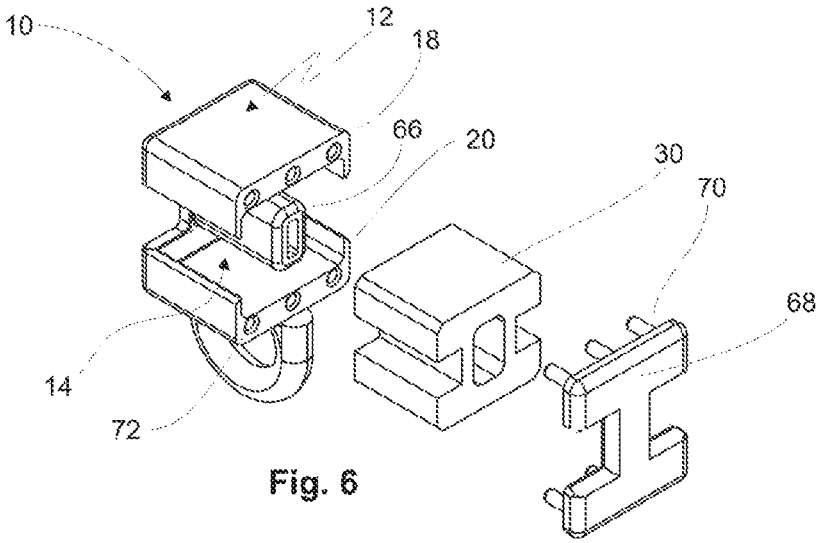
FIG. 6 is a schematic view of a fourth embodiment of a guide element according to the invention.

In another embodiment of the invention, showed in FIG. 6, the guide element 10 can comprise more than one piece wherein the pieces can be attached to each other to form the guide element 10 shown in FIG. 1A. According to this embodiment, the body 12 of the guide element 10 comprises the upper horizontal wall 18 with the wing extension and the lower horizontal wall 20 with wing extension and between the upper and the lower horizontal walls spaced apart a longitudinal extending element 66 of widely rectangular cross-section, joined together at one of the forward or rear vertical walls 22. The body 12 of the guide element 10 forms the recess 14 for receiving the insert 30. One front side of the body 12 is opened and is adapted to receive the insert 30 which is formed to fit into the formed recess 14. The opened front side of the body 12 of the guide element 10 can be closed with an end cap 68 shaped with a double T-shape comprising upper and lower horizontal walls 18, 20 with wing extensions. The end cap 68 can be fixedly attached to the body 12 of the guide element 10 through pins 70 provided on the end cap 68 which can be fitted into holes 72 provided at the opened front side of the body 12 of the guide element 10 or vice versa.

Figure 7:
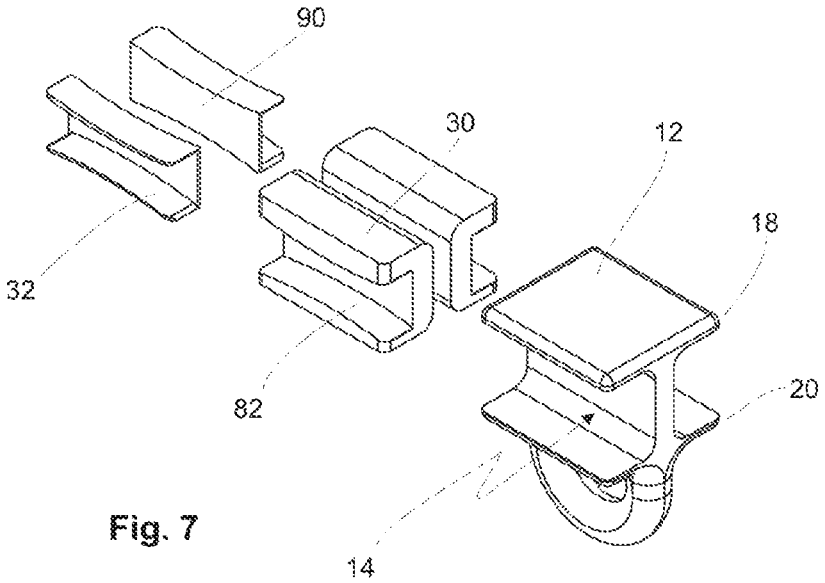
FIG. 7 is a schematic view of a fifth embodiment of a guide element according to the invention.

FIG. 7 shows another embodiment of the invention. The guide element 10 comprises a body 12 according to the embodiment of FIG. 1A, made of a rigid material like polyoxymethylen or polyamide or the like. The body 12 has the outwardly extending wings 18, 20 defining the recesses 14. The recesses 14 are designed to accommodate an insert 30 which is made of damping material like a rubber material showing a shore hardness of a softer plastic. The shore A hardness scale measures the hardness of flexible mold rubbers that range in hardness from very soft to hard and from flexible to almost no flexibility. Preferably the shore A hardness is selected properly. The insert 30 is provided for absorbing vibrations and noise caused by gliding of the guide element 10 along the guide track 40 (not shown). The insert 30 is bonded in appropriate way into the recesses 14 of the body 12 of the guide element 10. The insert 30 is formed with outwardly extending wings related to the wings 18, 20 of the body 12. Furthermore the insert 30 shows slightly convex surfaces 82. Shown in FIG. 7 elements 90 are made of a more rigid material. The elements 90 are formed to be inserted in the recesses each formed by the upper and lower outwardly extending wings of the insert 30. The elements 90 arranged in the recesses formed in the insert 30 provide the slightly convex shaped linear surfaces 32.

The elements 90 are formed with small wall thickness. Therefore when accommodated into the insert 30 the elements 90 forms a thin layer or a coating adapted to provide the sliding surface 32. The thin layer or coating shows excellent gliding properties wherein the insert 30 can absorb the vibration and the noise.

Figure 8:
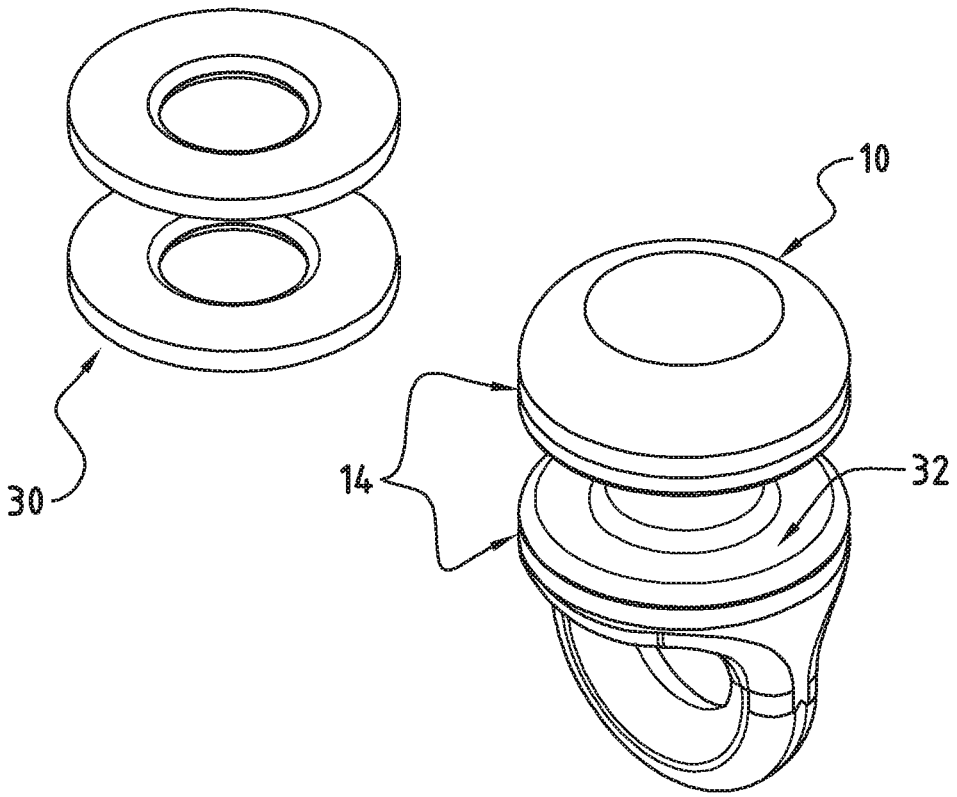
FIG. 8 is a schematic view of another embodiment of a guide element according to the invention.

FIG. 8 shows an alternative embodiment of the invention. The guide element 10 formed with a round body comprises recesses 14 formed as a notch wherein the inserts 30 are accommodated and secured respectively. The sliding surfaces 32 are provided by the guide element 10 and are made preferably of a more rigid material than the material of the insert 30.

Figure 9:
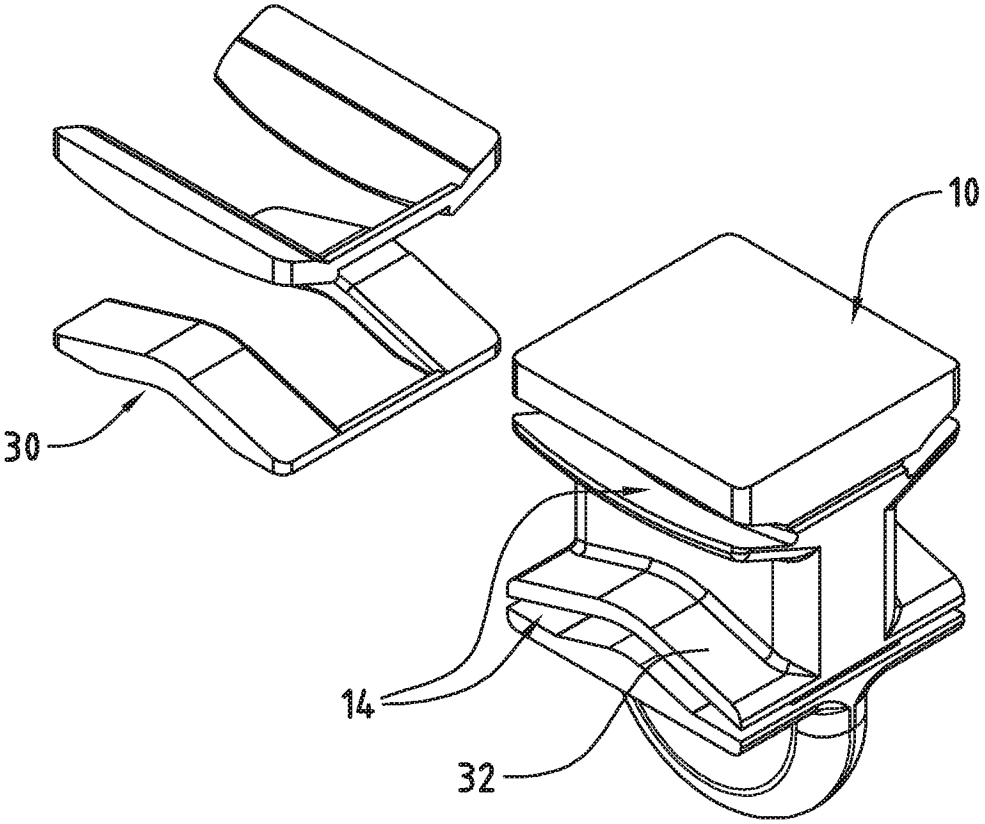
FIG. 9 is a schematic view of another embodiment of a guide element according to the invention.

FIG. 9 shows an alternative embodiment of the invention. The guide element 10 is in a form similar to the embodiment of FIG. 1A. The guide element 10 comprises recesses 14 formed as notches accommodating the inserts 30. The inserts 30 are made of another material as the guide element 10 which is made of a rigid material. According to this embodiment the sliding surfaces 32 are formed by the guide element 10.

The invention claimed is:

1. A system for suspension of a curtain device, the system comprising:

at least one curtain guide track ; and at least one curtain that is suspended on a plurality of suspension units with a guide element for guiding each suspension unit along the at least one curtain guide track, wherein the at least one curtain guide track and each guide element provide at least one bearing surface, and wherein a silencing material formed as an insert made of a soft material and having a sliding surface made of a rigid material that is more rigid than the soft material is provided on the at least one bearing surface.

2. The system according to claim 1, wherein the silencing material is made of at least one of fiber composites, synthetic materials, wood, and textile.

3. The system according to claim 2, wherein the silencing material is felt.

4. The system according to claim 1, wherein the silencing material is attached to the at least one bearing surface by at least one of adhesion, welding, injection-molding, crimping, and roll-in.

5. The system according to claim 1, wherein the guide element provides a recess in which the silencing material formed as an insert is attached.

6. The system according to claim 5, wherein the recess for accommodating silencing material formed as an insert is provided on the at least one bearing surface.

7. The system according to claim 6, wherein an element is bonded to the insert providing sliding surfaces, wherein the element is formed as a layer of a different material than the insert.

8. The system according to claim 6, wherein each guide element comprises a body providing the recess for receiving the insert and an end cap which is connectable to the body to secure the insert in the recess.

9. The system according to claim 1, wherein each guide element is formed as a glider for sliding along the at least one curtain guide track.

10. The system according to claim 9, wherein the glider is provided for inwardly or outwardly sliding along the at least one curtain guide track.

11. The system according to claim 1, wherein each guide element is a roller for rolling along the at least one curtain guide track.

12. The system according to claim 11, wherein the roller is suitable for inwardly or outwardly rolling along the at least one curtain guide track.

* * * * *